US007267454B2

(12) United States Patent
Yuen

(10) Patent No.: US 7,267,454 B2
(45) Date of Patent: Sep. 11, 2007

(54) UNIVERSAL CHARGEABLE ELECTRO-OPTICAL ILLUMINATING LAMP

(75) Inventor: Se Kit Yuen, Kwun Tong (HK)

(73) Assignee: John Manufacturing Ltd., Hong Kong (HK)

( * ) Notice: Subject to any disclaimer, the term of this patent is extended or adjusted under 35 U.S.C. 154(b) by 90 days.

(21) Appl. No.: 11/201,176

(22) Filed: Aug. 10, 2005

(65) Prior Publication Data

US 2006/0238997 A1 Oct. 26, 2006

(30) Foreign Application Priority Data

Apr. 21, 2005 (CN) ..... 2005 2 0011839

(51) Int. Cl.
*F21L 13/06* (2006.01)

(52) U.S. Cl. ..... 362/183; 362/800; 362/208

(58) Field of Classification Search ..... 362/183, 362/800, 192, 208, 204, 205, 190, 202, 184
See application file for complete search history.

(56) References Cited

U.S. PATENT DOCUMENTS 2,642,520 A * 6/1953 Keely et al. ..... 362/183
6,959,999 B2 * 11/2005 Lee ..... 362/192

* cited by examiner

*Primary Examiner*—Sharon Payne
(74) *Attorney, Agent, or Firm*—McDonnell Boehnen Hulbert & Berghoff LLP

(57) ABSTRACT

A universal chargeable electro-optical illuminating lamp includes: a housing, a lighting unit installed at the front end of the housing, a battery chamber installed in the housing, wherein at least one chargeable battery is installed in the battery chamber and connected to the lighting unit via a switching button, an movable plug installed moveably at the rear end of the housing and connected to a driving circuit device which is connected with the chargeable battery and provided in the housing, a hand grip connected moveably to the housing, wherein the movable plug is contained in the hand grip, and a manual charging device installed on the housing and connected to the chargeable battery. This invention can be used as an important lighting source, and has the advantages of environmental conservation and energy saving, and it can be charged and used under any circumstance.

10 Claims, 9 Drawing Sheets

UNIVERSAL CHARGEABLE ELECTRO-OPTICAL ILLUMINATING LAMP

FIELD OF THE INVENTION

The invention relates to an electro-optical illuminating lamp, more particularly, to a universal chargeable electro-optical illuminating lamp which is easy to be charged.

Discussion of the Related Art

Illuminating lamps are widely used in many aspects of the people's life. Generally, dry batteries or chargeable batteries are used in electro-optical illuminating lamps. A chargeable battery type electro-optical illuminating lamp is well known and usually provided with a fixed charging plug at its end to charge the lamp. However, the lamp with such structure becomes large and sometimes it is difficult to insert the plug into a receptacle which is located in a smaller space, thereby it is adverse to perform the charging operation. Furthermore, since all the present chargeable electro-optical illuminating lamps are charged with the commercial power, it is difficult to perform charging operation in the places where the commercial power is hard to be found, such as the suburb, which causes an inconvenience for the user.

SUMMARY OF THE INVENTION

The object of the invention is to provide a universal chargeable electro-optical illuminating lamp, which is convenient for the user to perform charging operation, more particularly to perform charging operation in the case that the commercial power is hard to be used.

For achieving the above object, the invention provides a universal chargeable electro-optical illuminating lamp including a housing; a lighting unit installed at the front end of the housing; a battery chamber installed in the housing, wherein at least one chargeable battery is installed in the battery chamber and connected to the lighting unit via a switching button; an movable plug installed moveably at the rear end of the housing and connected to a driving circuit device which is connected with the chargeable battery and provided in the housing; a hand grip connected moveably to the housing, wherein the movable plug is contained in the hand grip; and an assembly manual charging device installed on the housing and connected to the chargeable battery.

According to the concept of the invention, the hand grip is in a rectangular shape and can be pivotably moved between a first position and a second position, wherein while at the first position, the hand grip and the housing are located in the same horizontal line; and while at the second position, the hand grip is perpendicular to the housing and the movable plug extends out of the rear end of the housing.

According to the concept of the invention, the lighting unit includes at least one LED lighting source, at least one reflective mirror in a shape of a paraboloid and at least one transparent front plate, wherein at least one convex lens, which can converge the light emitting from the LED source, is provided in the centre of the front plate, and the reflective mirror reflects the light emitting from the LED illuminating source and emits the light out of the housing via the front plate.

According to the concept of the invention, the switching button is installed in the centre of a rotating shaft which connects rotatablely the hand grip and the housing.

According to the concept of the invention, the assembly manual charging device includes combinational gears, a motor generator and a rocking hand grip contained in an upper portion of the housing, wherein the rocking hand grip can drive the combinational gears to rotate, so that the motor generator can be activated to generate electricity.

According to the concept of the invention, a moveable battery cover is provided at the lower portion of the battery chamber.

According to the concept of the invention, two rotating shaft bulges and two rectangular guiding holes are provided at the rear end of the housing, the movable plug is provided with two circular rotating shaft holes engaging with said two rotating shaft bulges, and an end of the movable plug is provided with metal conducting pins which pass through the guiding holes.

According to the concept of the invention, the rotating shaft circular holes are provided on both the upper side and the lower side of the front end of the hand grip, rotatable locks are provided in the rotating shaft circular holes, flange buckles are provided on the rotatable locks, the rotatable locks can pass through the rotating shaft circular holes of the hand grip and the rotating shaft circular holes of the housing, and the flange buckles can movably fasten an inner surface of the housing.

According to the concept of the invention, an end of the rocking hand grip is connected rotatablely with a handle ring.

According to the concept of the invention, the handle ring is contained in a recess at the upper portion of the housing.

That is, the invention provides a universal chargeable electro-optical illuminating lamp which includes a housing. The housing includes a lighting source, a convenient charging plug, a hand grip and an assembly manual charging device. The hand grip can be rotated between a first position and a second position. While at the first position, the hand grip and the housing are located in the same horizontal line for providing the user with a suitable grip when holding. While at the second position, the hand grip is perpendicular to the housing. The charging plug can extend out of the rear end of the housing so as to realize the charging operation for the lamp. When the user is in the suburb or under the circumstance without the commercial power, he can make the assembly manual charging device generate electricity by rotating the rocking hand grip, so as to realize the charging operation for the universal chargeable electro-optical illuminating lamp.

The universal chargeable electro-optical illuminating lamp according to the invention can be used as an important lighting source for police, fire protection, urgently saving, discipline army and civil use. The universal chargeable electro-optical illuminating lamp has the advantages of environmental conservation and energy saving, and it can be charged and used under any circumstance.

BRIEF DESCRIPTION OF THE DRAWINGS

The other features of the universal chargeable electro-optical illuminating lamp according to the invention will be described in detail with reference to the examples shown in the figures, wherein.

DETAILED DESCRIPTION OF THE INVENTION

Figure 1:
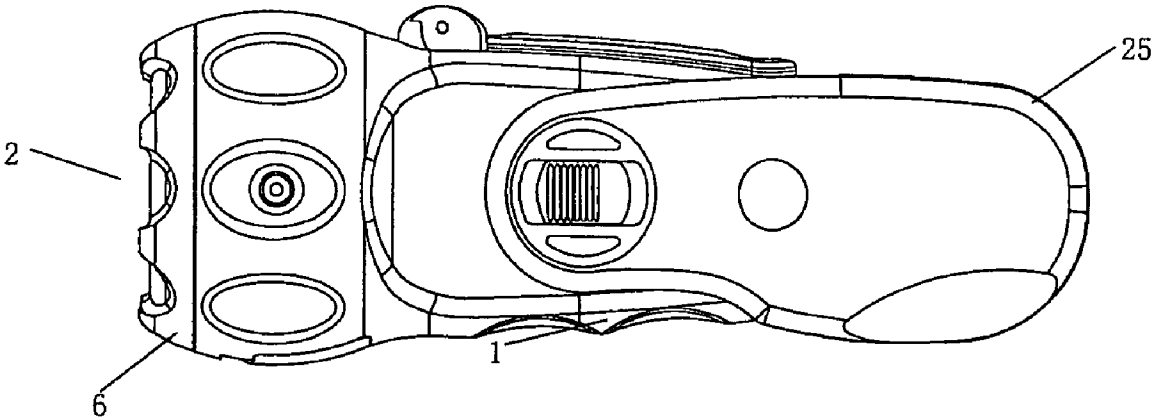
FIG. 1 shows a side view of the lamp according to the invention.
Figure 7:
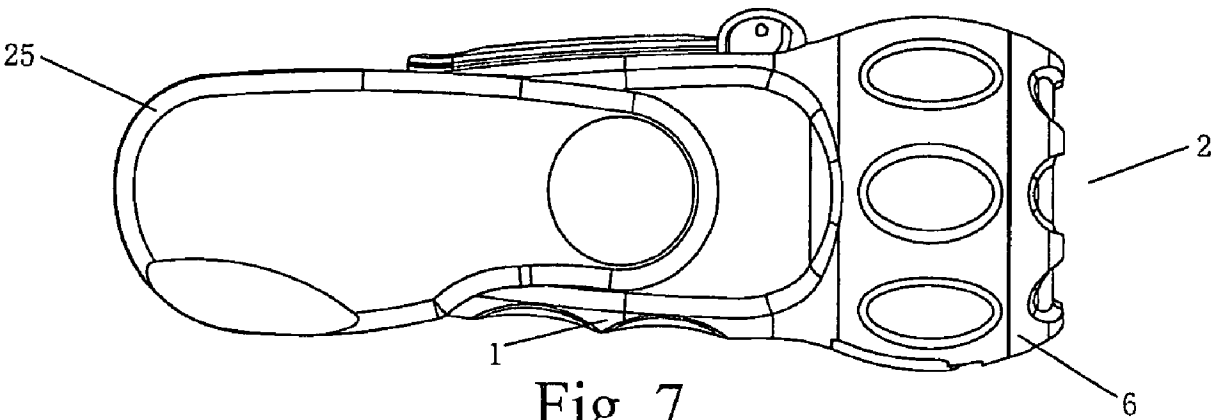
FIG. 7 shows another side view of the lamp shown in FIG. 1.
Figure 2:
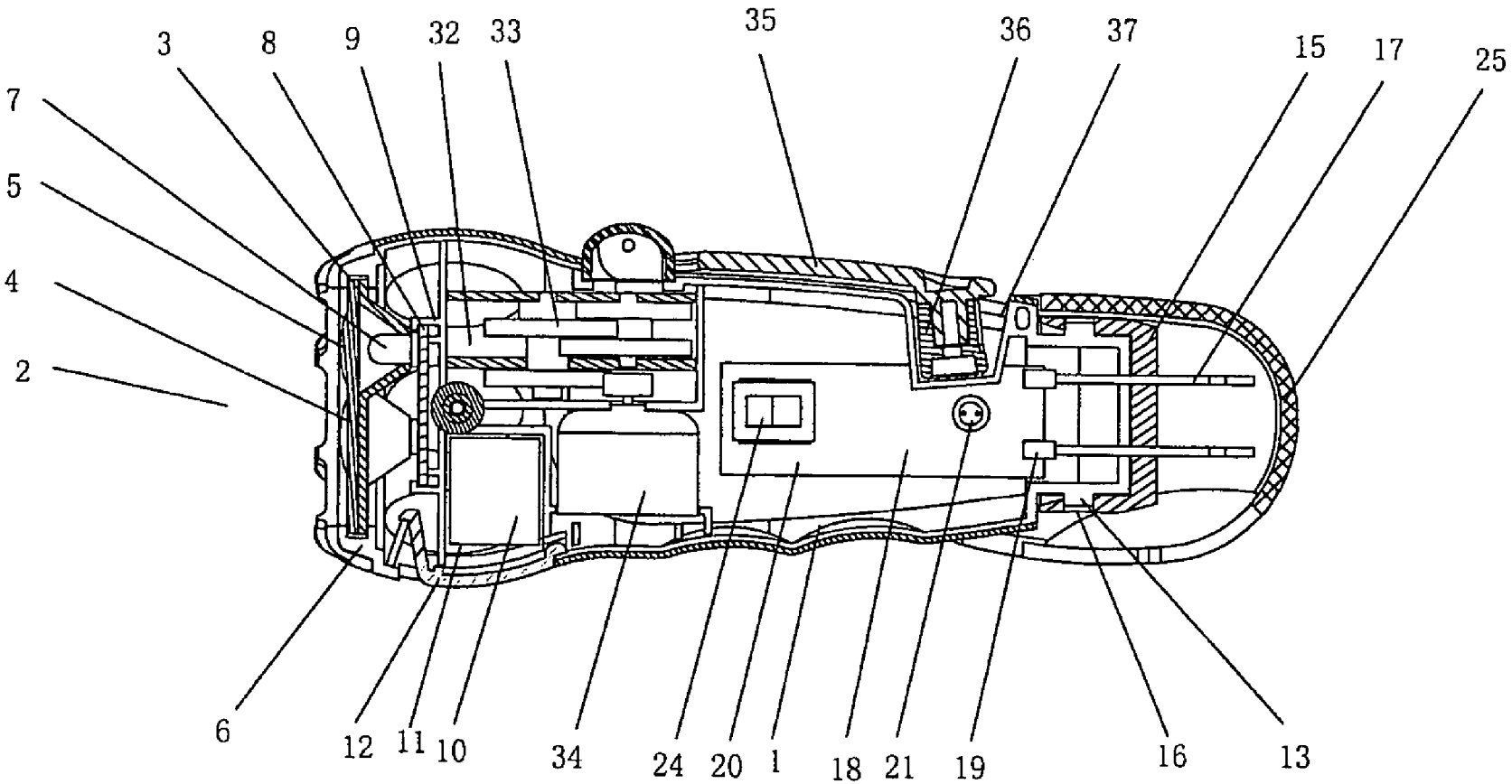
FIG. 2 shows a longitudinal section view of the lamp shown in FIG. 1.
Figure 3:
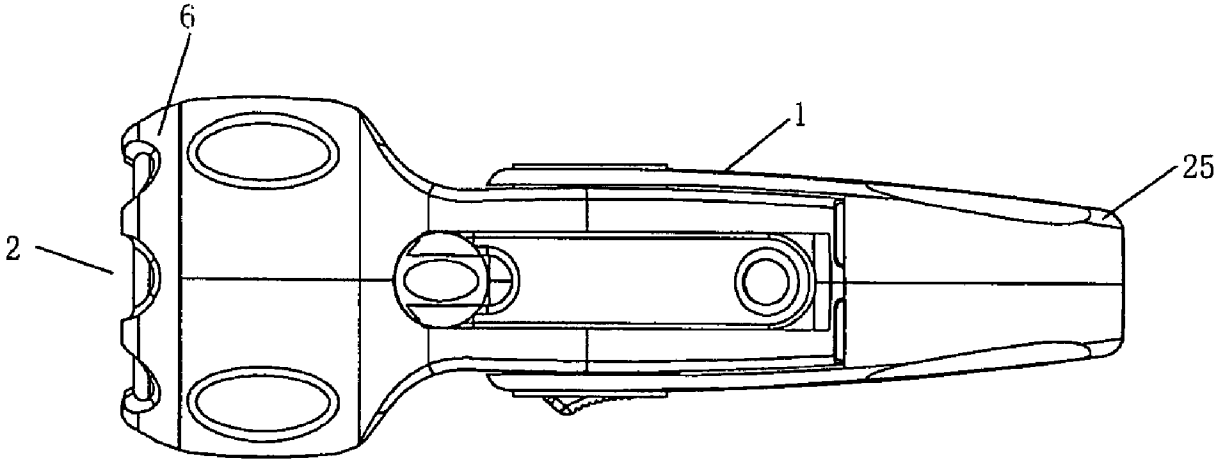
FIG. 3 shows a top view of the lamp shown in FIG. 1.
Figure 4:
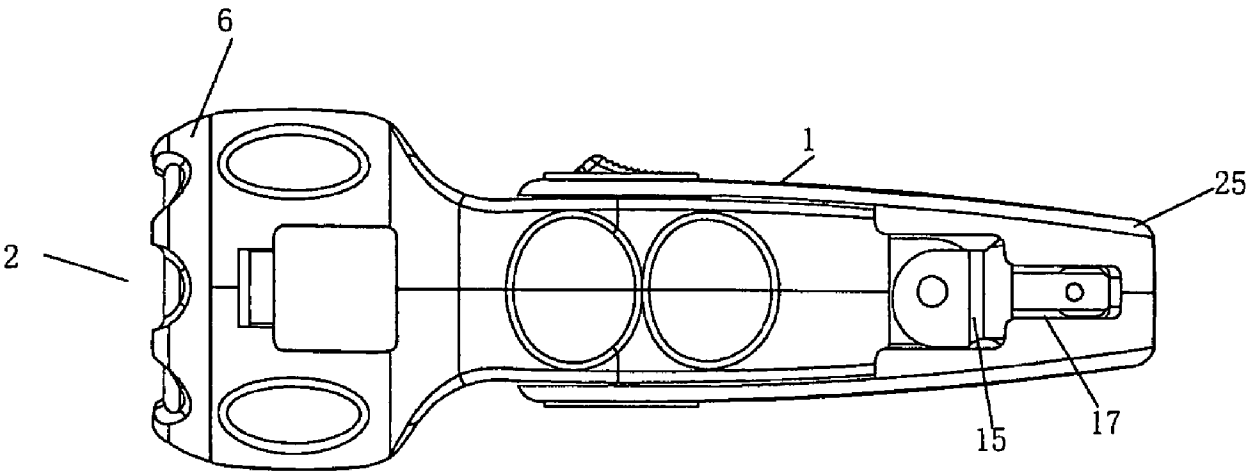
FIG. 4 shows a bottom view of the lamp shown in FIG. 1.
Figure 6:
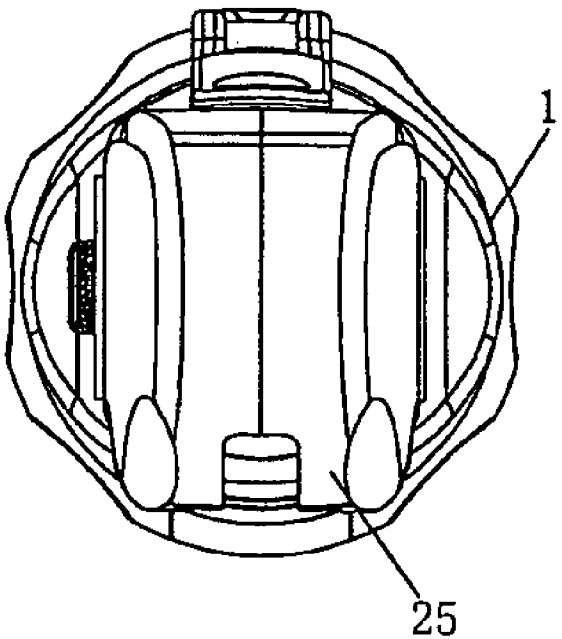
FIG. 6 shows a rear view of the lamp shown in FIG. 1.
Figure 5:
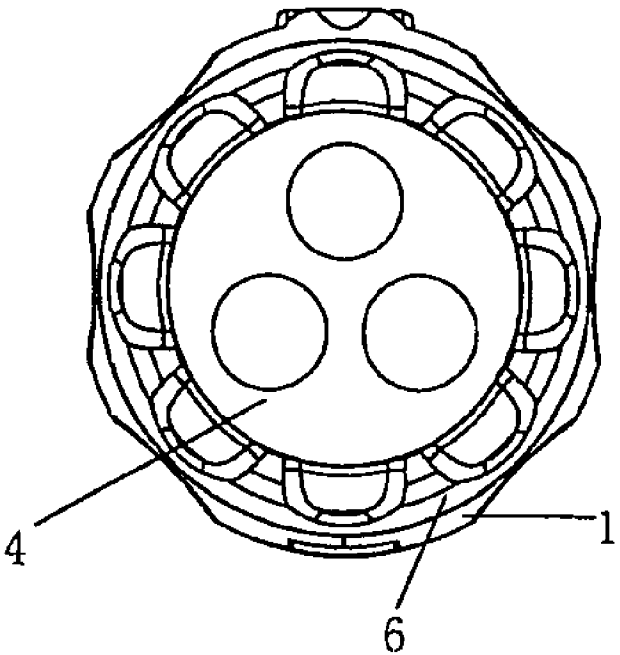
FIG. 5 shows a front view of the lamp shown in FIG. 1.
Figure 8:
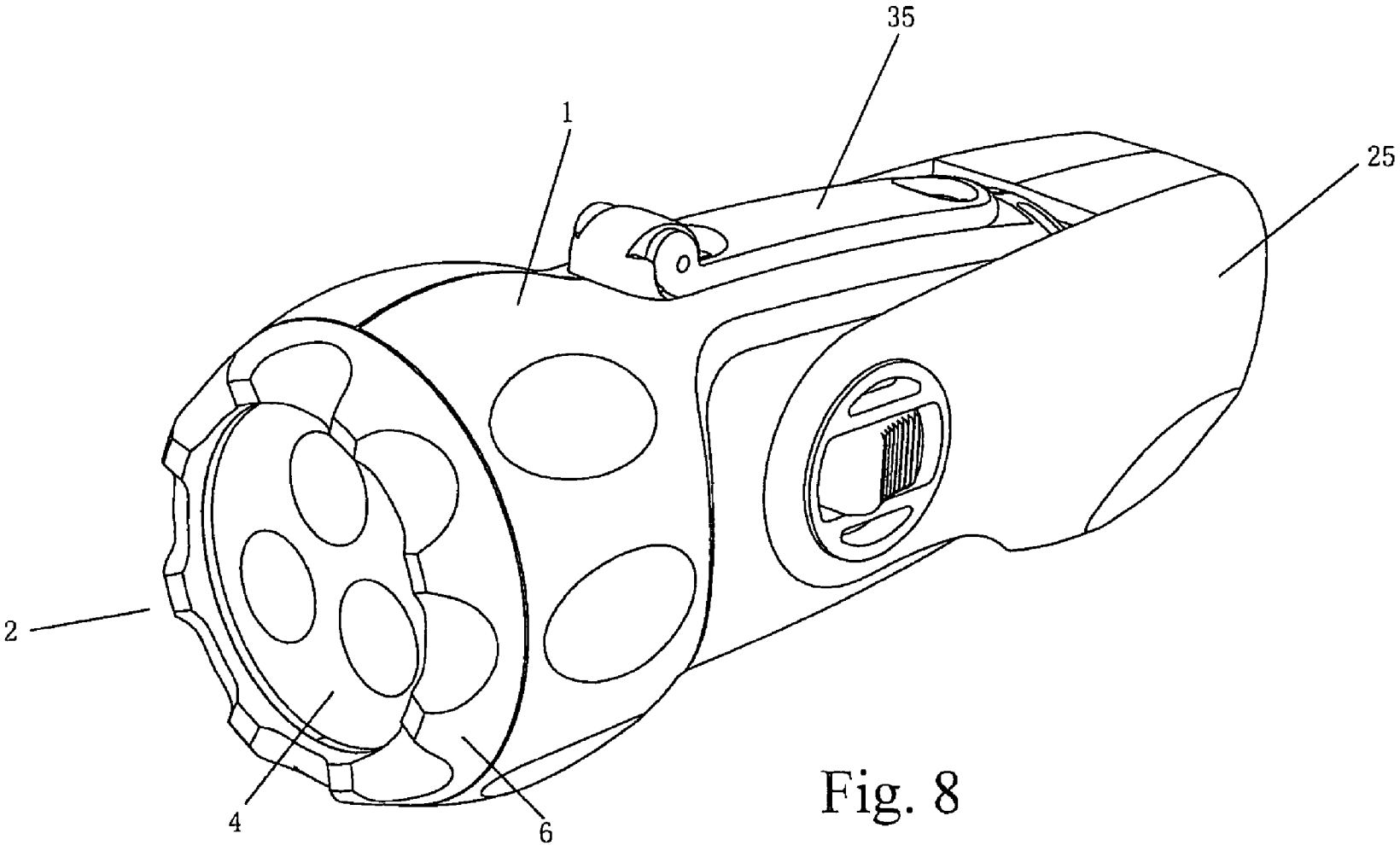
FIG. 8 shows a downward perspective view of the lamp shown in FIG. 1 and illustrates the first position of the hand grip relative to the housing.
Figure 9:
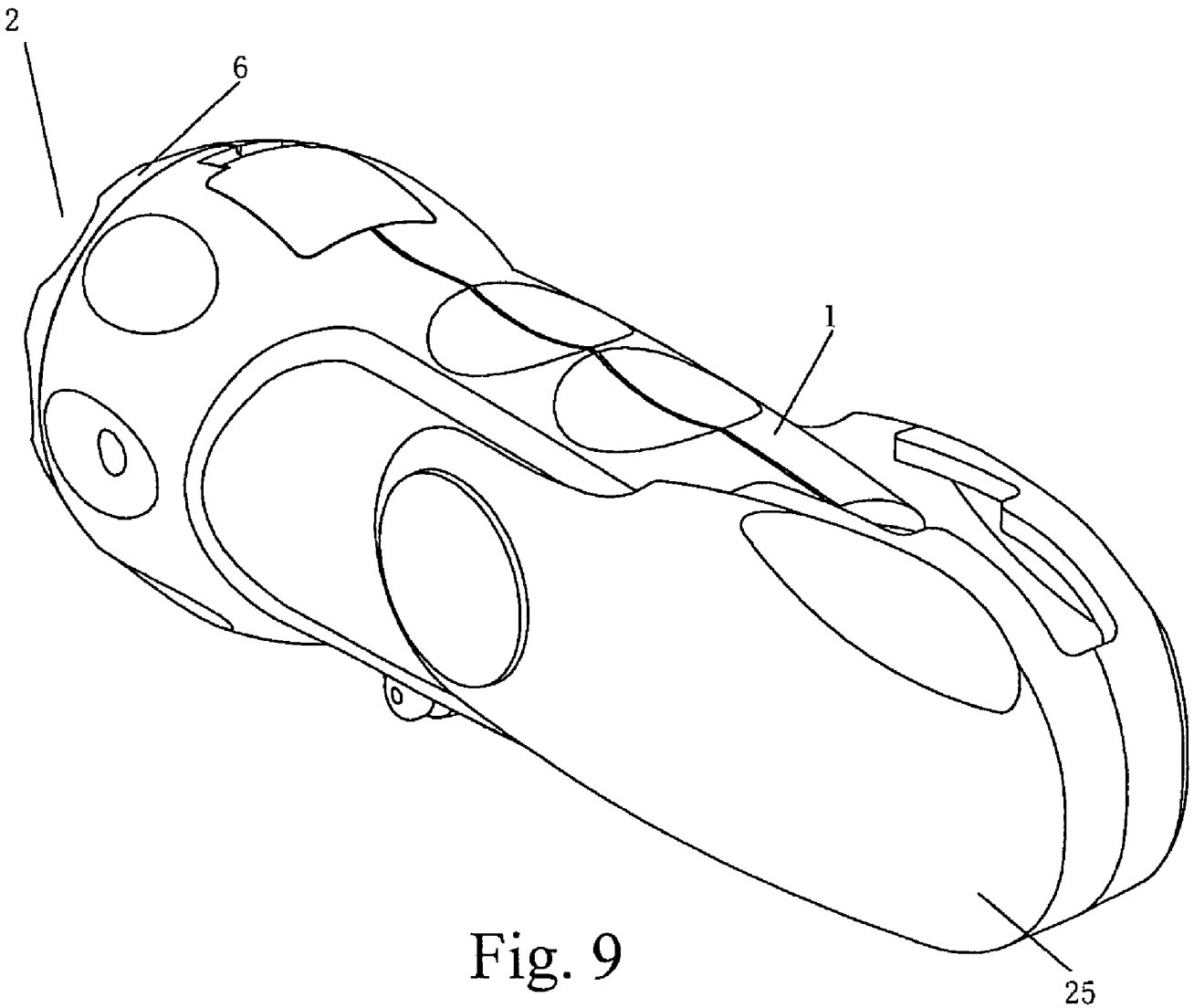
FIG. 9 shows a upward perspective view of the lamp shown in FIG. 1 and illustrates the first position of the hand grip relative to the housing.
Figure 10:
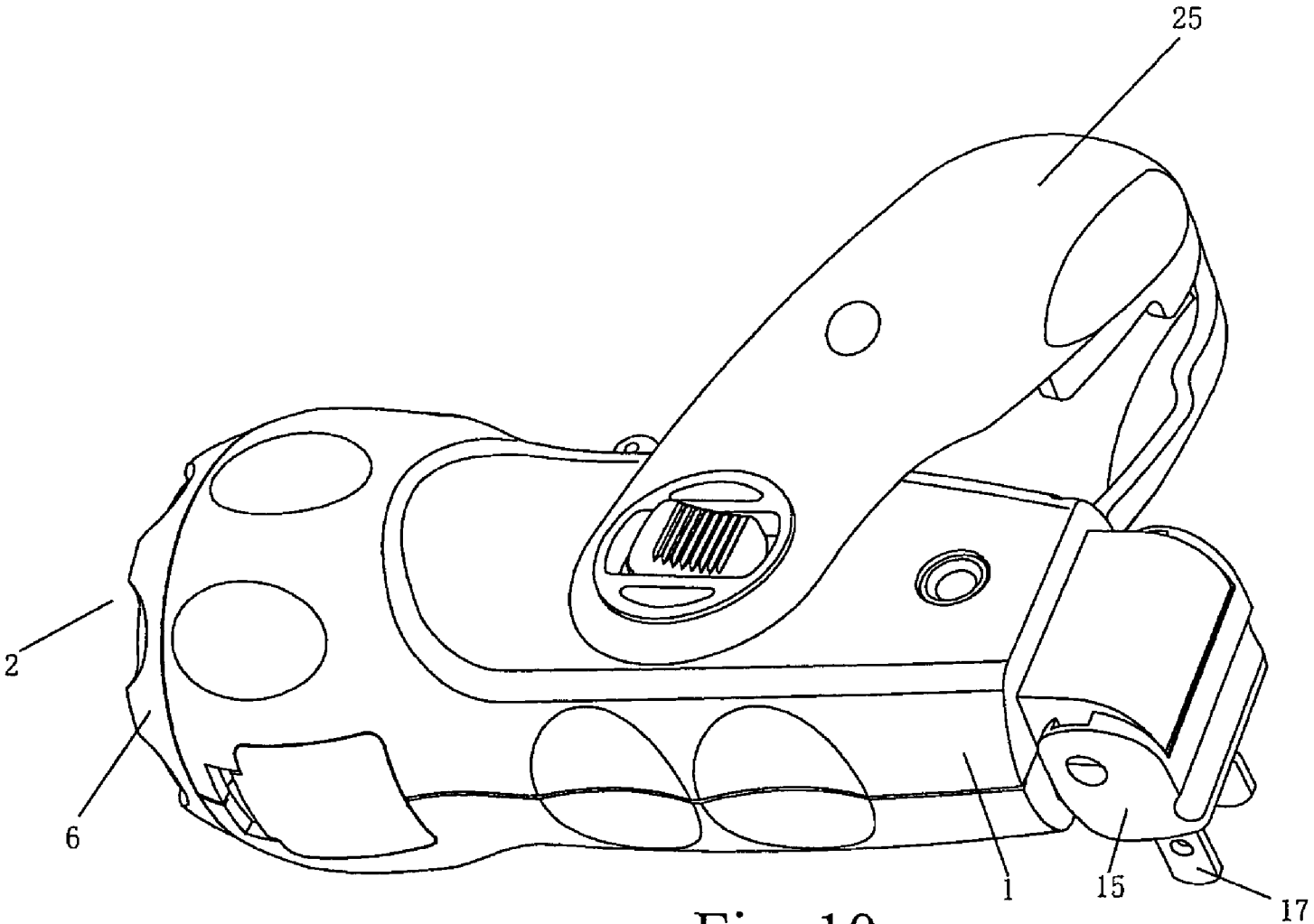
FIG. 10 shows another upward perspective view of the lamp shown in FIG. 1 and illustrates the second position of the hand grip relative to the housing.
Figure 11:
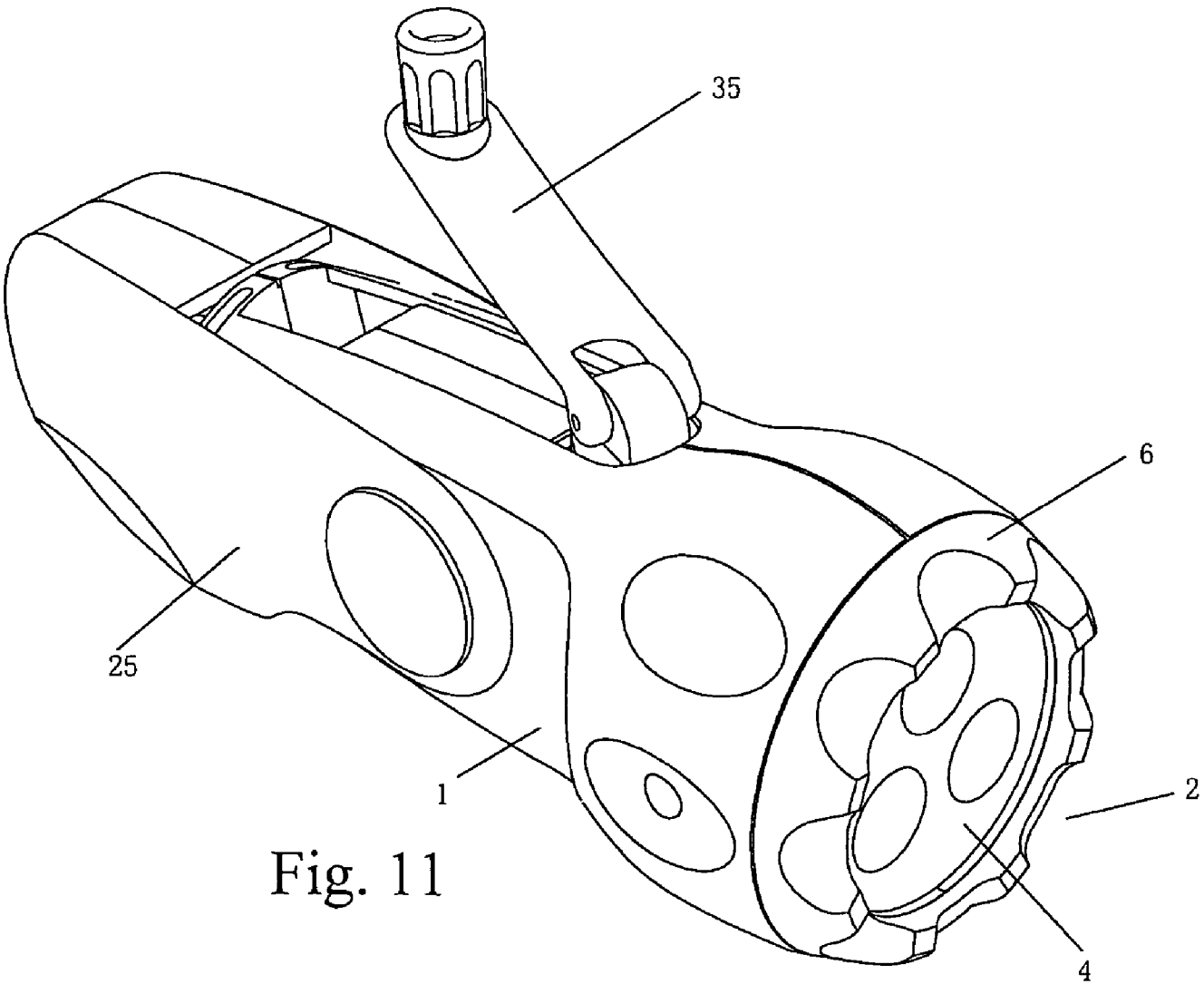
FIG. 11 shows another downward perspective view of the lamp shown in FIG. 1 and illustrates the position of the rocking hand grip of the assembly manual charging device relative to the housing in the using state.
Figure 12:
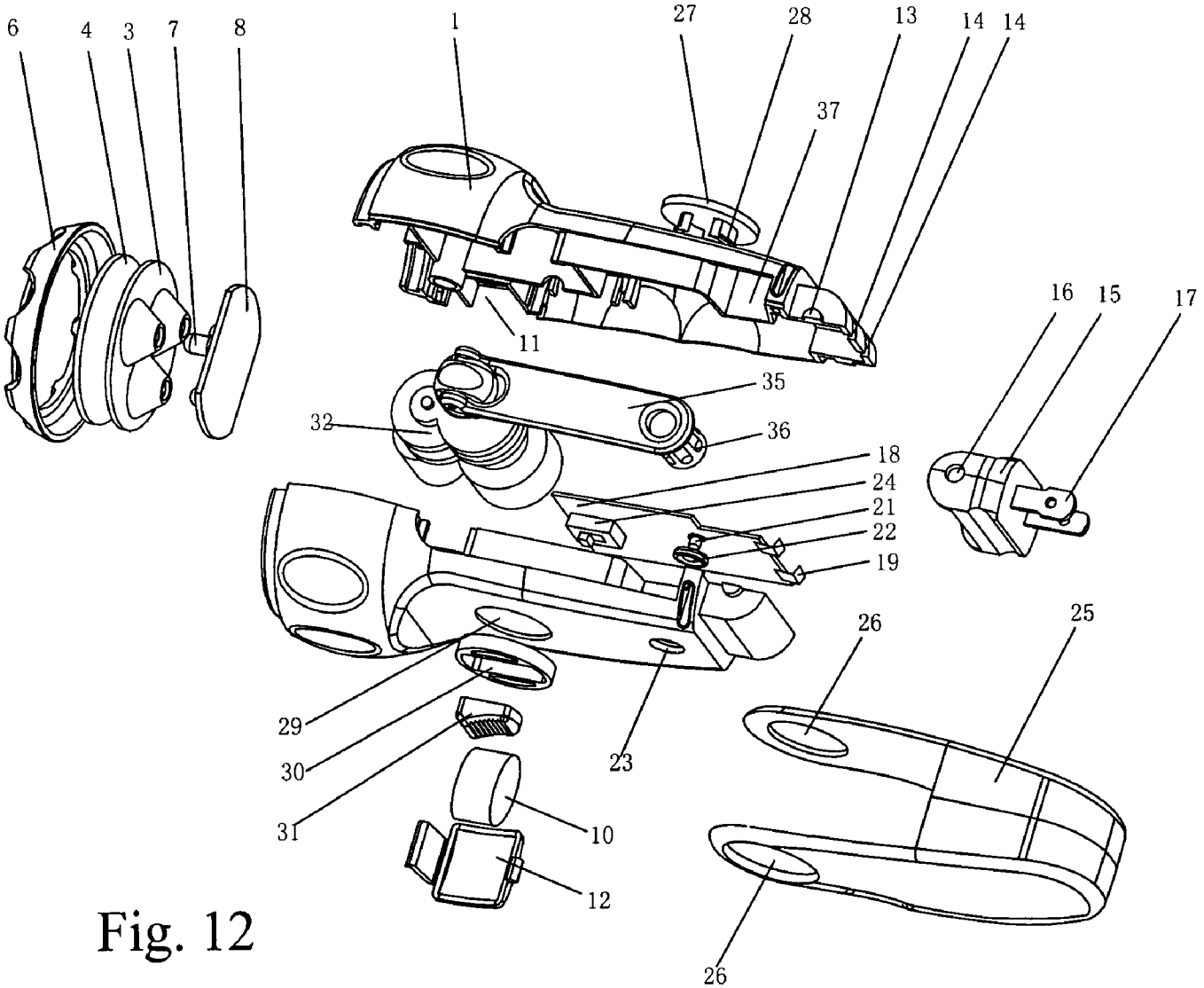
FIG. 12 shows an exploded perspective view of the lamp shown in FIG. 1.

The universal chargeable electro-optical illuminating lamp according to the invention includes a housing 1 generally in a shape of a rectangular cylinder. A lighting unit is installed in the housing 1 and includes a lighting source 2, a reflective mirror 3 generally in a shape of a paraboloid, and a front plate 4 made of glass or other transparent material. Three convex lenses 5 are provided on the front plate 4. The inner surface of the front plate 4 seals with the end face of the reflective mirror 3 located in a front ring cap 6. The ring cap 6 is fixed detachably at the front end of the housing 1.

As shown in the figures, the lighting source 2 is composed of three superradiant LEDs 7. The three superradiant LEDs 7 are electro-optical cold-cathode lighting sources which are energy saving lighting sources. The LEDs 7 are fixed on a circuit board 8 which is installed in the centre of a holder 9 at the front end of the housing 1. A battery chamber 11 for containing at least one chargeable battery 10 is provided at the lower portion of the housing 1. A moveable battery cover 12 is provided at the lower portion of the battery chamber 11 and fixed detachably at the lower portion of the housing 1. It is obvious that the chargeable battery 10 can be exchanged. Two rotating shaft bulges 13 and two rectangular guiding holes 14 are provided at the rear end of the housing 1. The two rotating shaft bulges 13 are engaged with two circular rotating shaft holes 16 of the movable plug 15. Two metal conducting pins 17 are provided on one end of the movable plug 15. The two metal conducting pins 17 can pass through the two rectangular guiding holes 14 at the rear end of the housing 1 and be inserted into a receptacle of the commercial power. The other end of the metal conducting pins 17 are connected movably and electrically to contact metal sheets 19 on the driving circuit board 18, so that the commercial power can be transmitted to a driving circuit device 20 on the driving circuit board 18 via these metal conducting pins 17. That is the commercial power can be transmitted into the housing 1 via the movable plug 15, thus the chargeable battery 10 in the housing 1 can be charged by the driving circuit device 20 which is connected to the housing 1 via wires. The chargeable battery 10 is connected electrically to the electro-optical lighting source 2 via a switching button 24. A charging indicator light 21 is provided on the driving circuit board 18. A transparent lens 22 is provided above the charging indicator light 21 and fixed in a circular hole 23 on the surface of the housing 1, so that it is convenient for the user to see the charging indicator light 21 through the transparent lens 22 fixed in a circular hole 23 on the surface of the housing 1.

The movable plug 15 at the rear end of the housing 1 can be contained in a hand grip 25, which is generally in a rectangular shape. Rotating shaft circular holes 26 are provided on both the upper side and the lower side of the front end of the hand grip 25. Rotatable locks 27 are provided in the rotating shaft circular holes 26. Flange buckles 28 are provided on the inner sides of the rotatable locks 27. The rotatable locks 27 can pass through the rotating shaft circular holes 26 of the hand grip 25 and the rotating shaft circular holes 29 of the housing 1. And the flange buckles 28 of the rotatable locks 27 can fasten the inner surface of the housing 1. It is obvious that the hand grip 25 and the housing 1 are connected rotatably by the rotatable locks 27, and the hand grip 25 can be rotated between a first position and a second position. At the first position, the hand grip 25 and the housing 1 are located in the same horizontal line for providing the user with a suitable grip when holding. At the second position, the hand grip 25 is perpendicular to the housing 1. The movable plug 15 can extend out of the rear end of the housing 1 and be inserted to a receptacle of the commercial power so as to realize the charging operation for the lamp.

A rectangular hole 30 is provided on one of the rotatable locks 27 on the housing 1. The switching button 24 is provided on the inner side of the rectangular hole 30 and a switching button cover 31 is provided on the outer side of the rectangular hole 30. The lower portion of switching button cover 31 can pass through the rectangular hole 30 of the rotatable lock 27 so as to connect with the switching button 24 closely. In other words, the user can push the switching button 24 by pushing the switching button cover 31.

An assembly manual charging device 32 is installed at the upper portion of the housing 1, and includes combinational gears 33, a motor generator 34 and a rocking hand grip 35. One end of the rocking hand grip 35 is connected movably to the upper portion of the manual charging device 32, and the other end of the rocking hand grip 35 is connected rotatably to a handle ring 36. The handle ring 36 of the rocking hand grip 35 can be contained in a recess 37 at the upper portion of the housing 1 so that the user can hold the housing 1 conveniently. The rocking hand grip 35 can be pulled up by the user and rotated clockwise or anticlockwise. At this time, the rocking hand grip 35 drives the combinational gears 33 to rotate, so that the motor generator 34 can be activated to generate electricity for charging the chargeable battery 10.

It can be seen that the universal chargeable electro-optical illuminating lamp according to the invention provides the user with two kinds of convenient charging modes. For one charging mode, when the hand grip 25 is rotated to the second position where the hand grip 25 is perpendicular to the housing 1, the movable plug 15 can extend out of the rear end of the housing 1 and be inserted in a receptacle of the commercial power so as to charge the lamp. For the other charging mode, the rocking hand grip 35 can be pulled up from the surface of the housing 1 by the user and rotated clockwise or anticlockwise, at this time, the rocking hand grip 35 drives the combinational gears 33 to rotate and then the motor generator 34 is activated to generate electricity for charging the chargeable battery 10, thus the charging operation of the lamp is achieved. After having been charged, the universal chargeable electro-optical illuminating lamp according to the invention can illuminate for a plurality of hours.

What is claimed is:

1. A universal chargeable electro-optical illuminating lamp includes:

a housing, a lighting unit installed at the front end of the housing, a battery chamber installed in the housing, wherein at least one chargeable battery is installed in the battery chamber and connected to the lighting unit via a switching button, a movable plug installed moveably at the rear end of the housing and connected to a driving circuit device which is connected with the chargeable battery and provided in the housing, a hand grip connected moveably to the housing, wherein the movable plug is contained in the hand grip, and an assembly manual charging device installed on the housing and connected to the chargeable battery.

2. The universal chargeable electro-optical illuminating lamp according to claim 1, wherein the hand grip is in a rectangular shape and can be pivotably move between a first position and a second position, wherein while at the first position, the hand grip and the housing are located in the same horizontal line, and while at the second position, the hand grip is perpendicular to the housing and the movable plug extends out of the rear end of the housing.

3. The universal chargeable electro-optical illuminating lamp according to claim 1, wherein the lighting unit includes at least one LED lighting source, at least one reflective mirror in a shape of a paraboloid and at least one transparent front plate, wherein at least one convex lens, which can converge the light emitting from the LED lighting source, is provided in the centre of a front plate, and the reflective mirror reflects the light emitting from the LED lighting source and emits the light out of the housing via the front plate.

4. The universal chargeable electro-optical illuminating lamp according to claim 1, wherein the switching button is installed in the centre of a rotating shaft which connects rotatably the hand grip and the housing.

5. The universal chargeable electro-optical illuminating lamp according to claim 1, wherein the assembly manual charging device includes combinational gears, a motor generator and a rocking hand grip contained in an upper portion of the housing, wherein the rocking hand grip can drive the combinational gears to rotate, so that the motor generator can be activated to generate electricity.

6. The universal chargeable electro-optical illuminating lamp according to claim 1, wherein a moveable battery cover is provided at the lower portion of the battery chamber.

7. The universal chargeable electro-optical illuminating lamp according to claim 1, wherein two rotating shaft bulges and two rectangular guiding holes are provided at the rear end of the housing, the movable plug is provided with two circular rotating shaft holes engaging with said two rotating shaft bulges, and an end of the movable plug is provided with metal conducting pins which pass through the guiding holes.

8. The universal chargeable electro-optical illuminating lamp according to claim 1, wherein a rotating shaft circular holes are provided on both the upper side and the lower side of the front end of the hand grip, rotatable locks are provided in the rotating shaft circular holes, flange buckles are provided on the rotatable locks, the rotatable locks can pass through the rotating shaft circular holes of the hand grip and the rotating shaft circular holes of the housing, and the flange buckles can movably fasten an inner surface of the housing.

9. The universal chargeable electro-optical illuminating lamp according to claim 5, wherein an end of the rocking hand grip is connected rotatably with a handle ring.

10. The universal chargeable electro-optical illuminating lamp according to claim 9, wherein the handle ring is contained in a recess at the upper portion of the housing.

* * * * *